US005641936A

United States Patent [19]

Sochard et al.

[11] Patent Number: 5,641,936

[45] Date of Patent: Jun. 24, 1997

[54] ACTIVE INFRARED FUZE

[75] Inventors: Irving I. Sochard, Chevy Chase; James E. Swanekamp, Beltsville; Rodney E. Grantham, Bethesda; Marcella C. Petree, Silver Spring, all of Md.

[73] Assignee: The United States of America as represented by the Secretary of the Navy, Washington, D.C.

[21] Appl. No.: 395,964

[22] Filed: Sep. 11, 1964

[51] Int. Cl.[6] ..... F42C 13/02

[52] U.S. Cl. ..... 102/213

[58] Field of Search ..... 102/70.2, 211, 102/213; 250/83.3; 343/12, 12.4, 6 IR

[56] References Cited

U.S. PATENT DOCUMENTS 2,861,165 11/1958 Aigrain et al. ..... 250/83.3 IR X 2,925,965 2/1960 Pierce ..... 250/83.3 U X

*Primary Examiner*—Michael J. Carone

*Assistant Examiner*—Christopher K. Montgomery

[57] ABSTRACT

A proximity fuze which employs a reflected beam of pulse modulated infrared radiation to determine the distance from the weapon to the target. Modulation is accomplished electronically. Correlation circuitry comprising a logic network is provided to continuously compare the received signal with the modulation signal.

2 Claims, 2 Drawing Sheets

ACTIVE INFRARED FUZE

The invention described herein may be manufactured and used by or for the Government of the United States of America for Governmental purposes without the payment of any royalties thereon or therefor.

This invention relates to the art of proximity fuzes for missiles. More particularly, it relates to a proximity fuze which employs a reflected beam of infrared radiation to determine the distance from the weapon to the target and to detonate the weapon when a predetermined distance or distance within a range of distances is reached. The term "missiles", as used herein, is intended to encompass all forms of projectiles such as bombs, rockets, and the like.

The invention is an improvement over such prior art active infrared fuzes as described by Ferrel in U.S. Pat. No. 2,255,245, issued Sep. 9, 1941 or Giraudo, U.S. Pat. No. 3,055,303, issued Sep. 25, 1962. in Ferrell, a beam of infrared rays is projected toward the target, reflected therefrom and received on a photocell when the weapon is at a predetermined distance from the target. The distance is determined by adjusting the angular relationship between the projector and receiver so that the reflected beam will fall on the receiver only at the predetermined distance. The receiver is sensitive to infrared radiation only so that the device may discriminate between its own projected radiation and external sources of non-infrared radiation. The Farrell device remains susceptible, however, to improper operation due to external sources of infrared such as the sun for example, and is highly vulnerable to countermeasures since any source of infrared radiation directed toward the weapon will detonate it in order to obviate this problem, it has been proposed to modulate the transmitted radiation and to use a detecting system which responds only when the received signal is modulated at the same frequency as the transmitted signal. Such an arrangement is shown, for example, in the Giraudo patent where a mechanical modulator consisting of a wind-driven rotary chopper is employed and a phase bridge is used to compare the transmitted with the received frequency. In employing a mechanical modulator, however, this device incorporates the disadvantages inherent in all devices having moving mechanical parts, such as wear.

The present invention is an improvement on the Giraudo system in that a fully electronic system is employed, thus avoiding the difficulties inherent in a mechanical system. Since most, if not all, of the components of the present invention can be built in microelectronic form, the size of the entire system can be made quite small so that the device can be used in smaller weapons than has heretofore been possible with fuzes like the Giraudo fuze. Moreover, the present device accomplishes its intended purpose with a minimum number of components, thus enhancing its reliability.

Accordingly, it is an object of the present invention to provide an active infrared fuze which is wholly electronic, so that it can be packaged in microelectronic form, and which employs a minimum number of components.

Another object of the invention is to provide an active infrared fuze which has greater resistance to countermeasures then has been obtainable heretofore. This result is accomplished by utilizing a carrier frequency lying in an atmosphere absorption band. Such absorption bands are due, for example, to rotation vibration absorptions of $CO_2$ and $H_2O$ in the air, and under these conditions, the triggering radiation can travel only short distances through the atmosphere. Thus, even if the enemy could transmit a detonating ray to the weapon it would obviously have to have its transmitter within that short distance to do so. Moreover, in the preferred embodiment to be described below, the geometrical arrangement is such that the detector "sees" the target only when the desired distance has been reached. Above that distance, the spot of which the detector is focused is not at the target, and in addition, if the weapon is rolling or rotating, the spot is not fixed. Thus effective countermeasures would appear virtually impossible to obtain.

With these and other objects and advantages in view, the invention consists of a source of infrared radiation of narrow bandwidth such as, for example, a gallium arsenide diode which is driven to luminescence by a pulse-modulated power supply. In the preferred embodiment, a photodetector is positioned within the weapon and oriented so as to receive the modulated radiation reflected from the target only when the weapon has reached a predetermined distance from the target. Correlation circuitry in the weapon continuously compares the received signal to the transmitted frequency. When the weapon is not at the predetermined distance, the photodetector will "see" only noise within its band of sensitivity. The correlation circuitry produces no output under those conditions. When the transmitted radiation falls on the photodetector, a signal at the transmitted frequency will appear and the correlation circuitry then provides a signal to fire the weapon.

Other objects and advantages will be apparent from the following detailed description when considered in conjunction with the accompanying drawings wherein.

Figure 1:
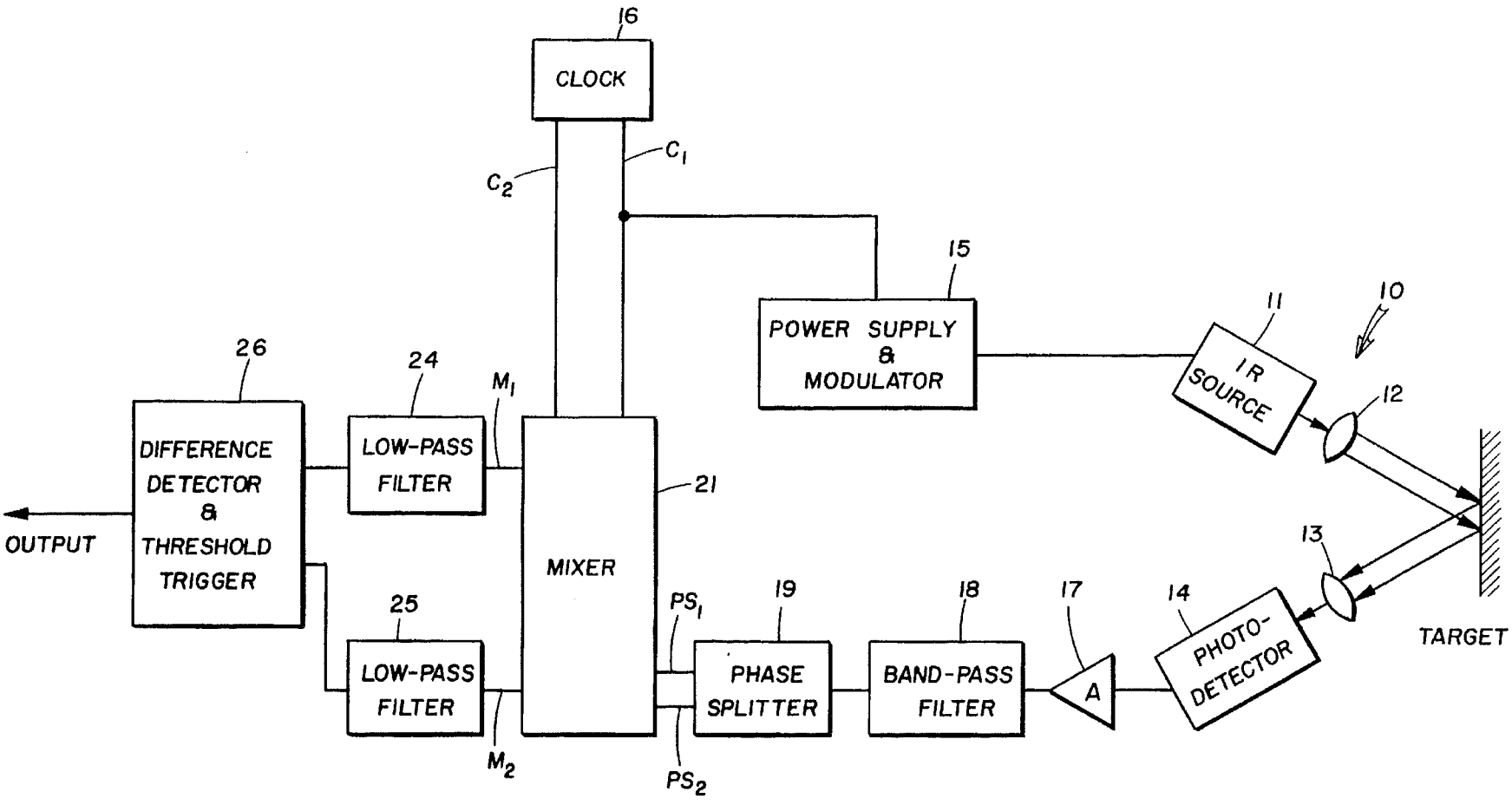
FIG. 1 is a functional block diagram of the present invention.

Referring now to FIG. 1, illustrating the preferred embodiment of the invention, the optical part of the system is generally designated at 10 and consists of the infrared source 11 oriented as in Ferrell to project a beam toward the target, transmitting optics 12, receiving optics 13 and photodetector 14. Receiving optics 13 and photodetector 14 are focused and oriented so as to receive the reflection of the transmitted radiation only when the weapon is at the predetermined distance from the target. If desired, an optical filter for the photodetector 14 may be inserted in the optical path to pass only those frequencies in the neighborhood of the transmitted carrier frequency.

A filter may also be employed at the source to further limit the bandwidth of the transmitted radiation. Infrared source 11 is preferably a p-n junction diode, such as a GaAs diode, which emits radiation near the junction or depletion region when a driving current is applied thereto. There are now diodes available which can be brought to lasing action with the proper driving current; however, lasing action is not deemed necessary to the operation of the present device. A diode such as the GaAs diode fluoresces at room temperature, and this simple junction fluorescence has been found to be sufficient to obtain reflected recognizable signals at the ranges contemplated for this device. Other diode materials provide different wavelength, thus permitting selection of a carrier frequency lying in an atmosphere absorption band as noted above. The junction diode is selected as the infrared source in this invention because of its advantages of small size, low power dissipation, narrow bandwith and modulation capabilities. Of course, photodetector 14 must be compatible with the transmitter selected in that it must be capable of detecting the transmitted carrier frequency. Photodetector 14 may be, for example, a solidstate photodiode or phototransistor. With a GaAs source, a silicon phototransistor would be suitable.

Infrared source 11 is driven by a power supply and modulator 15 which is responsive to a clock 16. A square wave pulse is available at the output of the power supply and modulator, and therefore the infrared source is caused to fluoresce intermittently at the modulating frequency. Clock 16 has two outputs, $C_1$ and $C_2$ each carrying a positive square wave pulse, one being on while the other is off for a purpose to appear more fully hereinafter. From photodetector 14, the circuit consists of an amplifier 17, a bandpass filter 18 and a phase splitter 19. The incoming signal, consisting either of the ambient noise or the reflected signal mixed with the ambient noise, is amplified in amplifier 17 and passed through the bandpass filter 18 where noise signals that could over-drive the phase splitter 19 are reduced. The signal is then transmitted to the phase splitter in which a second signal is derived which is of the same shape as the incoming signal but is adjusted to be complementary therewith. These two signals are then passed to the mixer 21 which compares each of the clock signals referred to above with each of the two signals from the phase splitter.

Figure 2:
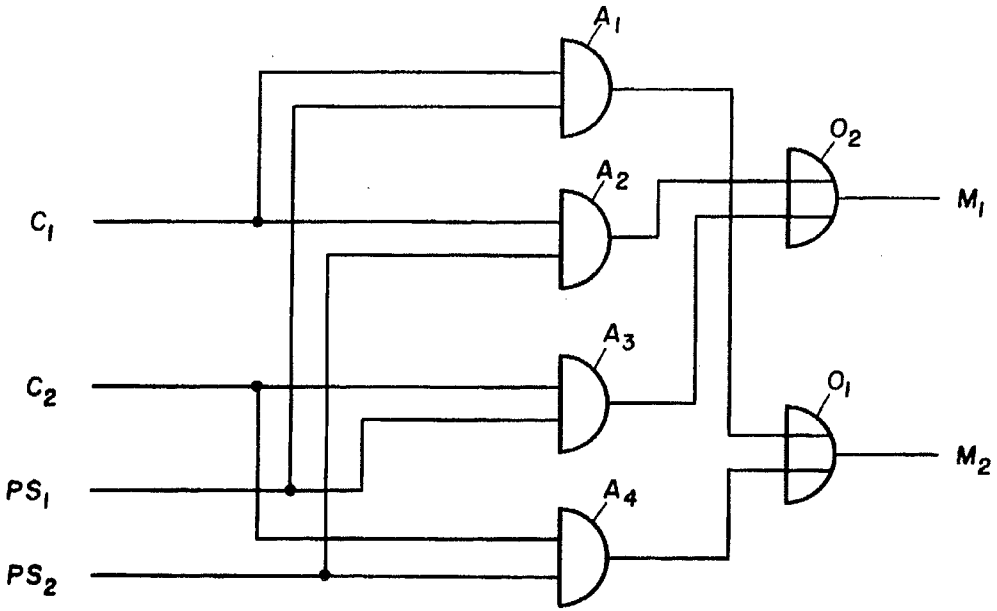
FIG. 2 is a diagram of the mixer logic circuitry.

Mixer 21 consists of AND and OR gate logic circuitry in the arrangement shown in FIG. 2. The two leads from clock 16, identified as $C_1$ and $C_2$, and the two leads from the phase splitter, identified as $PS_1$ and $PS_2$ are shown at the left side of the figure. Four AND gates are shown at $A_1$, $A_2$, $A_3$ and $A_4$ respectively. AND gate $A_1$ compares $C_1$ and $PS_1$ to supply an output if signals are present on each of these lines. AND gate $A_2$ compares $C_1$ and $PS_2$. AND gate $A_3$ compares $C_2$ and $PS_1$ and AND gate $A_4$ compares $C_2$ and $PS_2$. The outputs of $A_1$ and $A_4$ go to OR gate $O_1$ and the outputs of $A_2$ and $A_3$ are supplied to a second OR gate $O_2$. The two outputs of the OR gates are the two outputs of the mixer as shown in FIG. 1 at $M_1$ and $M_2$. The operation of mixer 21 will be described below.

The signals on leads $M_1$ and $M_2$ are filtered by low pass filters 24 and 25, respectively, in order to eliminate any remaining high frequency signals, and are then supplied to a difference detector and threshold trigger 25. Difference detector anti threshold trigger 26 may be, for example, a simple SCR circuit triggered to provide an when the voltage difference between signals on lines $M_1$ and $M_2$ achieves a predetermined value.

The operation of the invention will now be described, first with reference to a situation where the weapon is not at the predetermined distance from the target, and then for the situation where the predetermined distance has been reached. If the weapon is not at the predetermined distance, the photodetector 14 "sees" only the ambient noise of the environment, or at least the noise within the bandwidth of the optical filter if one is employed. This ambient noise could include reflected or direct sunlight, infrared sources on the ground or at the target, etc. Under these circumstances, the noise would be amplified in amplifier 17, some of it eliminated in the bandpass filter 18, and the outputs from phase splitter 19 on lines $PS_1$ and $PS_2$ under these conditions would be substantially the same, assuming that the noise is random. Considering then the first half cycle of the clock output and assuming that $C_1$ is on and $C_2$ is off during this period, the output from AND gate $A_1$ would be on because of the $C_1$ on condition and the presence of a signal, albeit noise, on line $PS_1$. The output of AND gate $A_2$ would be on because of the on condition of line $C_1$ and the noise on $PS_2$. The output of AND gate $A_3$ would be off because of the off condition of $C_2$, and the output of AND gate $A_4$ would also be off because of the absence of a signal on $C_2$. However, since AND gate $A_1$ is on the output of OR gate $O_1$ would be on. The output of OR gate $O_2$ would be on because of the fact that AND gate $A_2$ is on. Outputs of equal level would therefore be present on lines $M_1$ and $M_2$ and the difference detector 26 would accordingly provide no output. The analysis of the logic circuitry during the second half cycle of the clock output proceeds on similar lines with the same result obtaining.

Figure 3:
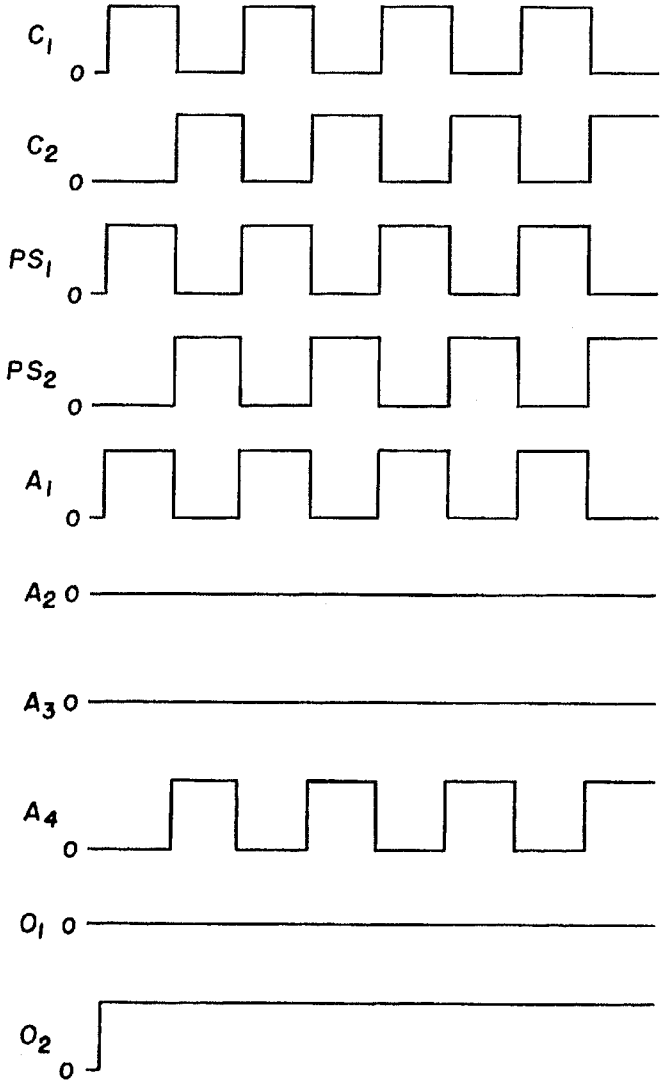
FIG. 3 is a diagram of the pulse comparisons which are made in the mixer.

Referring now to FIG. 3, the situation is there shown in which a reflected signal is being received by the photodetector. The four signals on $C_1$, $C_2$, $PS_1$ and $PS_2$ are shown as the top four wave diagrams in the figure. While the signal on $PS_1$ is shown as in phase with the signal on $C_1$ and the signal on $PS_2$ is shown in phase with the signal of $C_2$, it is to be understood that there may be some phase difference involved because of the different travel times involved between the clock 16 and the mixer 21 and between the IR source and the mixer. The signals on $PS_1$ and $PS_2$ will be delayed by a time interval $$t=\frac{2h}{c}$$

where h is the distance to the target and c is the velocity of light. Since the distance h for the present device is envisioned to be a maximum of about 100 feet for radiation in an atmosphere absorption band, the time interval is of the order of 0.2 microseconds, which is negligible for present purposes. It should be here noted that since the present device does not rely on a phase shift to measure distance, as is done in some radar applications, it is possible to keep the modulating frequency quite low. Among other things, this has the advantage that expensive high frequency components are not required in the receiving circuitry. Another advantage is economy since components capable of operating at low frequencies are generally much less expensive than high frequency components. It is also to be understood that while the signals on $PS_1$ and $PS_2$ are shown as smooth square waves, there is still in actual practice a certain amount of noise which is superimposed on the signals. FIG. 3 is therefore representative of the ideal no-noise situation.

Now, considering mixer 21 on the assumption of these particular conditions, the following will hold true. At AND gate $A_1$ there is a signal on $C_1$ and a signal on $PS_1$ and therefore the output of AND gate $A_1$ is on. The output of AND gate $A_2$, however, is off since there is a signal on $C_1$ but no signal on $PS_2$. AND gate $A_3$ is off since there is no signal on $C_2$. At AND gate $A_4$ there is no signal on $C_2$ or $PS_2$, therefore the output of $A_4$ is off. Since both inputs to OR gate $O_2$ are off, line $M_1$ has no signal, i.e. a zero voltage level. However, since AND gate $A_1$ is on OR gate $O_1$ will be on and a signal will appear on line $M_2$. During the second half cycle AND gates $A_1$ and $A_2$ will be off because $C_1$ is off. AND gate $A_3$ will be off because $PS_1$ is off. AND gate $A_4$, however, will be on because $PS_2$ is on and $C_2$ is on. Consequently, again there will be no output from OR gate $O_2$ because AND gates $A_2$ and $A_3$ are off. However, there will be an output on line $M_2$ because AND gate $A_4$ is now on. There will therefore be a constant d.c. voltage on line $M_2$ with respect to line $M_1$. The difference detector will then provide a trigger pulse to detonate the weapon. It is not material how the hookup is made in the mixer as long as each of the clock signals is compared with each of the signals from the phase splitter. Likewise, it is not material which of the clock outputs is used to control the modulator. The d.c. voltage will appear on one or the other of leads $M_1$ or $M_2$ irrespectively, depending on the circumstances. It is to be understood that the optical arrangement employed is not limited to the specific geometrical arrangement described above, especially when operating in an atmosphere absorption band. The width and divergence of the transmitted beam and the viewing cone of the receiver may be arranged with a long overlap so that the distance over which the instrument receives the reflection is extended. As a result, the necessity of using components capable of fast response is eliminated.

It is therefore to be understood that within the scope of the appended claims the invention may be practiced otherwise than as specifically described.

What is claimed is:

1. An active infrared fuzing system for a missile comprising:

a clock for producing two pulsed signals of equal height and width, one of said pulsed signals being on while the other is off and vice versa, a power supply and modulator controlled by one of said pulsed signals to provide a similarly pulsed current, a p-n diode fluorescent means connected to said power supply and responsive to said pulsed current to produce a pulsed beam of infrared radiation, said p-n diode being oriented to direct said beam toward a target, a photodetector oriented to receive the reflection of said beam from the target only when said missile is at a predetermined distance from said target and to convert the incident radiation to an electric signal, a phase splitter connected to said photodetector for duplicating said photodetector signal and shifting it in phase, thus providing two equal signals which are complementary to each other, a mixer containing logic circuitry for comparing each of said clock pulse signals with each of the signals from the phase splitter, said mixer having two outputs on which equal signals appear if the photodetector is not receiving the reflected radiation and on which d.c. signals of different voltage level appear when said photodetector is receiving the reflected radiation, and a difference detector and threshold trigger for providing a firing signal when the different voltages appear.

2. An active infrared fuzing system for a missile as recited in claim 1 wherein said mixer comprises:

four AND gates, the first of said pulsed signals from said clock being supplied to the first and second AND gates and the second of said pulsed signals being supplied to the third and fourth AND gates, one signal of said phase splitter being supplied to the first and third AND gates and the complement signal of said phase splitter being supplied to the second and fourth AND gates, and two OR gates, the outputs of the second and third AND gates being supplied to the first OR gate and the outputs of the first and fourth AND gates being supplied to the second OR gate, the outputs of said OR gates being the two outputs of said mixer.

* * * * *